US005825134A

United States Patent [19]

Ito

[11] Patent Number: 5,825,134

[45] Date of Patent: Oct. 20, 1998

[54] METHOD OF HOLDING FIELD EMISSION CATHODE IN ITS STANDBY STATE

[75] Inventor: Fuminori Ito, Tokyo, Japan

[73] Assignee: NEC Corporation, Japan

[21] Appl. No.: 870,972

[22] Filed: Jun. 6, 1997

[30] Foreign Application Priority Data

Jun. 10, 1996 [JP] Japan ..... 8-147454

[51] Int. Cl.[6] ..... H01J 23/04

[52] U.S. Cl. ..... 315/169.1; 315/3; 315/169.3; 313/309

[58] Field of Search ..... 313/309, 351, 313/497, 336; 315/169.1, 169.3, 167, 5.33, 3

[56] References Cited

U.S. PATENT DOCUMENTS

| | | | |
|---|---|---|---|
| 5,543,686 | 8/1996 | Huang et al. | 313/497 |
| 5,604,401 | 2/1997 | Makishima | 315/3 |
| 5,610,478 | 3/1997 | Kato et al. | 315/169.1 |

OTHER PUBLICATIONS

Yamabe et al; "Thickness Dependence of Dielectric Breakdown Failure of Thermal SiO2 Films"; 1983; pp. 184–190; IEEE.

Spindt et al; "Physical properties of thin–film field emission cathodes with molybdenum cones"; Dec. 1976; pp. 5248–5263; Journal of Applied Physics, vol. 47, No. 12.

*Primary Examiner*—Don Wong
*Assistant Examiner*—David H. Vu
*Attorney, Agent, or Firm*—Hayes, Soloway, Hennessey, Grossman & Hage, P.C.

[57] ABSTRACT

A field emission cathode has an emitter tip, on a conductive layer, disposed within holes that are formed through an insulating layer deposited on the conductive layer and a gate layer deposited on the insulating layer, respectively. A method according to the present invention comprises the step of applying to the gate layer an activation voltage to activate the emitter tip before operating the field emission cathode with operating gate voltages. The activation voltage is greater than any one of the operating gate voltages but less than a dielectric breakdown voltage.

11 Claims, 4 Drawing Sheets

METHOD OF HOLDING FIELD EMISSION CATHODE IN ITS STANDBY STATE

BACKGROUND OF THE INVENTION

1. Field of the Invention

The present invention relates to a method of and an apparatus for driving field emission cathodes.

2. Description of Related Art

Field emission cathodes are fabricated using thin-film techniques and electron beam microlithography. The technology of fabrication has been advanced, taking advantage of improvements instigated by the growing needs of the semiconductor industry.

On pages 5248–5263 of Journal of Applied Physics, Vol. 47, No, 12, December 1976, Spindt et al. submitted a report entitled "Physical properties of thin-film field emission cathodes with molybdenum cones." Molybdenum is reported as a particularly good material to use for the sharp pointed cones or emitter tips, from which the electrons are emitted. It is described that maximum currents in the range 50–150 $\mu$A per cone or emitter tip can be drawn with applied voltages in the range 100–300 V when operated in conventional ion-pumped vacuum at pressures of $10^{-9}$ Torr (=$10^{-7}$ Pa) or less.

Sharpening cones and increasing density of packed arrays containing cones expect high density of emission current with low applied voltages. For practical application, it is required that emission current increases to a desired level upon application of voltage with good response and reproducibility.

It is well known that emission property of field emission cathodes depends on the surface condition and shape of the cones. Cones are formed in vacuum, but they are exposed to atmosphere in the subsequent process including process where field emission cathodes are mounted in tubes. Exposing the cones to the atmosphere causes surface contaminants. Such contaminants may be unwanted molecules comprised of elements such as carbon and oxygen. The presence of surface contaminant renders the contaminated cone less efficient or inoperable for the designated purpose of the cones due to increased work function. For example, this causes a reduction of the field emission current and it also causes considerable variations thereof.

Particularly, the presence of surface contaminants causes instability observed in initial emission characteristic of electrons. That is, after application of a gate voltage, the initial emission characteristic of electrons deteriorates due to time dependence of variations of contaminants, such as separation of contaminants from the surface followed by adherence thereto.

For example, upon first application of gate voltage immediately after mounting field emission cathode in a cathode ray tube (CRT), it takes several tens of minutes, as aging time, after application of gate voltage until picture image is stabilized. In other words, a considerable amount of aging time passes until field emission current increases to a desired stable level corresponding to the applied gate voltage.

Similar situation occurs in the subsequent operation due mainly to the presence of residual gas. For example, upon application of gate voltage after extended period of time has passed since application of gate voltage last, a considerable amount of time is needed after application of voltage until field emission current increases to a desired high level corresponding to the applied gate voltage. In other words, the response is poor.

An object of the present invention is to improve a method of and an apparatus for driving field emission cathodes such that transient period of time for field emission current to increase to desired stable level is shortened.

SUMMARY OF THE INVENTION

According to the present invention, there is provided a method of holding a field emission cathode in a standby state ready for providing emission current when operated with applied one of predetermined operating gate voltages, the field emission cathode having an emitter tip, on a conductive layer, disposed within holes formed through an insulating layer deposited on the conductive layer and a gate layer deposited on the insulating layer, respectively, the method comprising the steps in sequence of:

applying to the gate layer an activation voltage having at least one voltage level that is not less than any one of voltage levels of the predetermined operating gate voltages to activate the emitter tip until any surface contaminants present on the emitter tip drop to a sufficiently low level; and applying to the gate layer one of the predetermined operating gate voltages to draw electrons out of the emitter tip to provide field emission current as high as a level corresponding to the applied operating gate voltage.

DETAILED DESCRIPTION OF THE INVENTION

Figure 1:
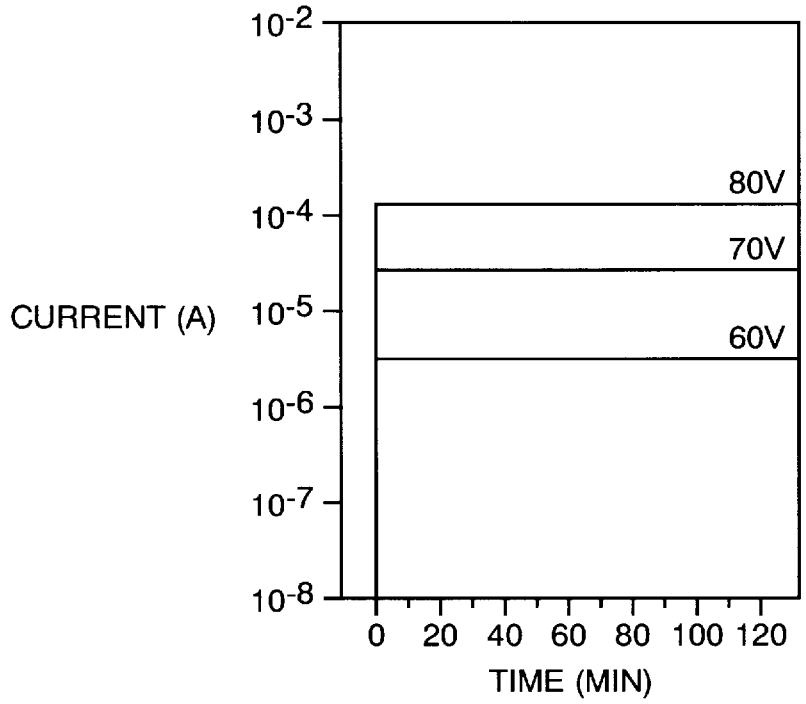
FIG. 1 shows time dependence of field emission current after application of three different operating gate voltages to a field emission cathode that is driven by a method and an apparatus according to the present invention.

Referring to the drawings, the present invention is further described along with the preferred embodiments.

Figure 3:
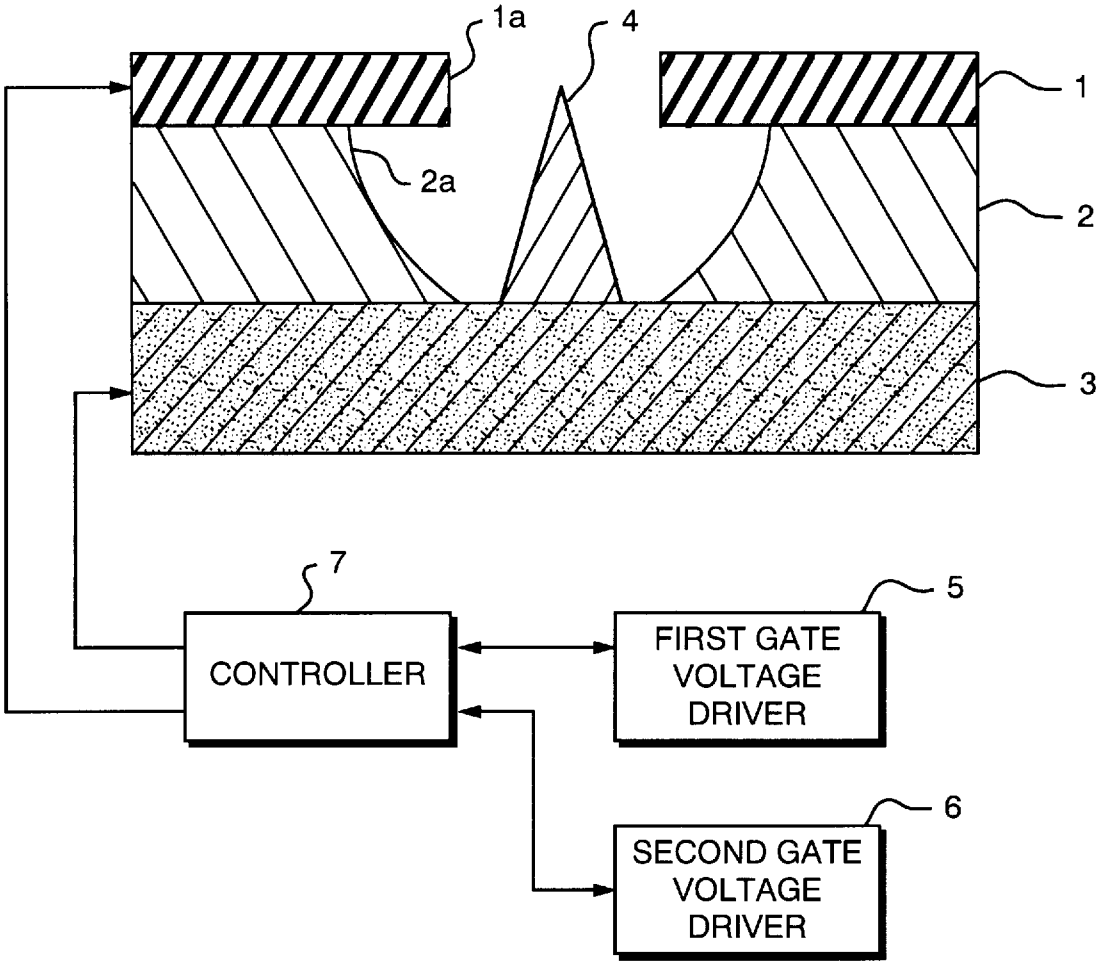
FIG. 3 is a schematic diagram, in section, of the field emission cathode with a block diagram of an apparatus for driving the field emission cathode.

Referring to FIG. 3, a conductive layer 3 is formed of n-type silicone highly doped with impurities. On this layer 3 is deposited by thermally growing silicone dioxide ($SiO_2$) an insulating layer 2 with a thickness of 500 nm. This layer 2 is covered by a molybdenum layer coating with a thickness of 200 nm, which is used as a gate 1. Through the gate layer 1 and the insulating layer 2 are then formed holes 1*a* and 2*a* by etching. Within the holes 1*a* and 2*a* is deposited by evaporation at normal incidence of molybdenum a cone used as an emitter tip 4. The fabrication of the field emission cathode is proposed by Spindt et al. in the above-mentioned report.

FIG. 1 shows time dependence of field emission current for three different operating gate voltages of 60 V, 70 V and 80 V applied first time after the field emission cathode has been mounted in a tube. According to the present invention, the emitter tip 4 is activated immediately before application of such voltages. In this example, it is considered that the emitter tip 4 has been activated when emission current reaches a level, which is expected to be reached for the applied operating gate voltage of 80 V that is the maximum of the operating gate voltages used in normal operating environments. An activation voltage that is higher than any of operating gate voltages that are used in normal operating environments is applied to the gate layer 1. For activation of the emitter tip 4, the activation gate voltage of 150 V is applied for 1 minute. It is seen from FIG. 1 that emission current desired for applied operating gate voltages are reached without any delay after application of such voltages.

Figure 2:
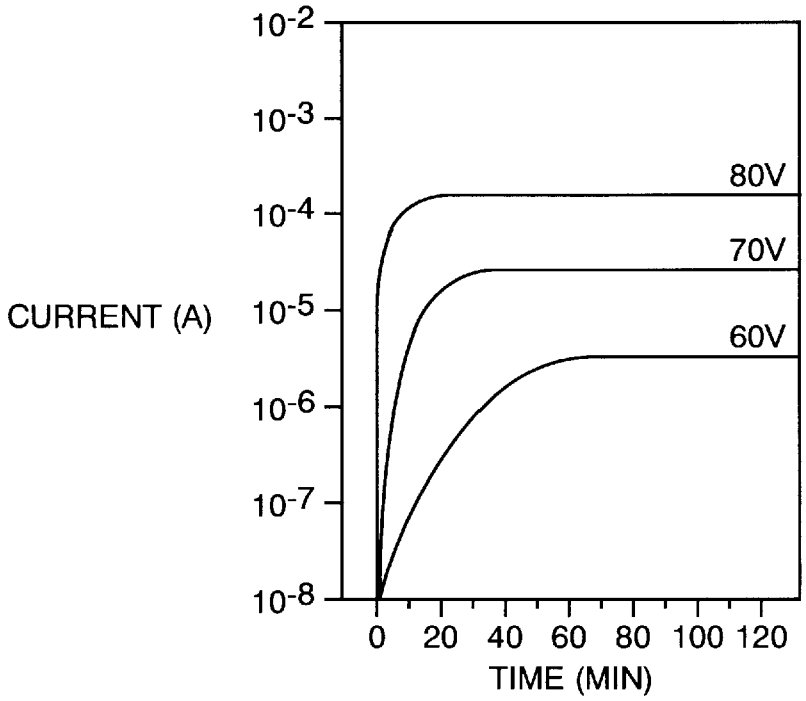
FIG. 2 shows time dependence of field emission current after application of three different operating gate voltages to a field emission cathode that is driven by a method and apparatus according to the prior art.

FIG. 2 shows time dependence of emission current for three different operating gate voltages in the case where emission tip is not activated. Emission current does not occur immediately after application of each of the three different gate voltages. As time passes, emission current gradually increases. It takes several tens of minutes for emission current to reach the desired level for each of the three different operating gate voltages. Period of time required for emission current to reach the desired stable level differs for different operating gate voltages and decreases as the gate voltage increases. 60 minutes are needed for the applied gate voltage of 60 V. 20 minutes are needed for the applied gate voltage of 70 V. 10 minutes are needed for the applied gate voltage of 80 V.

The emission current characteristic shown in FIG. 2 clearly indicates that the emitter tip does not generate electrons immediately after application of gate voltage unless the emitter tip is activated beforehand. This explains why emission of electrons is not stabilized after application of gate voltage first time after the field emission cathode has been mounted in a tube.

Comparing FIG. 1 with FIG. 2 reveals that the unstable initial emission characteristic of electrons encountered in the conventional case has been eliminated by activation of emitter tip according to the present invention.

Measurement of field emission current shown in FIG. 1 has been conducted in vacuum environment at pressures ranging from $10^{-7}$ Pa to $10^{-5}$ Pa. Thus, the measurement results shown in FIG. 1 apply to cathode ray tubes (CRTs) and flat panel displays where field emission cathodes operate in vacuum environment at pressure approximately $10^{-5}$ Pa within a tube.

Compared with vacuum environment at pressure $10^{-7}$ Pa, vacuum environment in these applications is disadvantageous in that a considerable amount of residual gas exits in a tube. This causes deterioration in field emission characteristic upon application of operating gate voltage after a long period of time passes since the gate voltage was applied last. This is because the number of molecules adhered to the surface increases within such long period of time.

To solve this problem, in the preferred implementation of the present invention, the emitter tip 4 is activated before application of operating gate voltage after a long period of time has passed since the gate voltage was applied last. The activation is effected in the same manner, as it was first time after the field emission cathode had been mounted in tube.

It is confirmed that, in operating vacuum environment at pressure of $10^{-5}$ Pa, the deterioration of field emission is noticeable upon application of operating gate voltage after 50 hours have passed since the gate voltage was applied last. Thus, the activation of the emitter tip 4 with the activation voltage of 150 V is needed before application of operating gate voltage after 50 hours have passed since the gate voltage was applied last This ensures stable field emission each time upon application of one of the operating gate voltages.

Time dependence of density of residual gas varies with vacuum around the field emission cathode. Specifically, the higher the vacuum around the field emission cathode is, the longer is the time required for the same number of molecules to adhere to the emitter tip. In other words, the period of time to pass before initiating the subsequent activation of the emitter tip 4 depends on the vacuum around the field emission cathode. Thus, if the field emission cathode operates in vacuum environment at pressures of $10^{-5}$ Pa or less, a period of time longer than 50 hours may be set.

As may be seen from FIG. 2, the time required for field emission current to reach the desired level corresponding to the applied operating gate voltage becomes short as the applied gate voltage increases. The gate voltage that may be applied to the gate layer has an upper limit This upper limit is determined based on dielectric breakdown voltage of the insulating layer 2.

In a report entitled "Thickness Dependence of Dielectric Breakdown Failure of Thermal $SiO_2$ Films" on pages 184 to 190 of 1983 IEEE/IRPS, Yamabe et al. separate oxide breakdown hystogram of oxides into three peaks. They call a peak with the breakdown field below 1 MV/cm A mode, a peak with the field of 1 MV to 8 MV/cm B mode and a peak with the field above 8 MV/cm C mode, respectively. The C mode failure is mainly due to intrinsic breakdown mechanism. Both the A mode failure and the B mode failure are related to extrinsic oxide defects. The A mode failure is due to initial short defects. The B mode failure is related to time dependent dielectric breakdown.

Thus, the upper limit of activation voltage should be a voltage corresponding to a breakdown field that is equal to 3 MV/cm or below taking reliability over extended period of time into account. It is confirmed that, with breakdown field exceeding 3 MV/cm, dielectric breakdown tends to take place.

In this embodiment, the thickness of the insulating layer 2 of silicone dioxide ($SiO_2$) is 500 nm. Thus, the upper limit of the activation voltage becomes 150 V (3 MV/cm). There are cases where, with the applied activation voltage of 150 V, desired result could not be obtained due to unevenness of shape of emitter tips or excessive contamination of conical ends of the emitter tips. In such cases, it is permitted to apply activation voltage that corresponds to breakdown field falling in a range of 3 MV/cm to 8 MV/cm. The application of such a high voltage must not continue beyond a short period of time of several seconds. This is because the short time application of such high activation voltage will not cause the time dependent dielectric breakdown.

Turning back to FIG. 3, an apparatus for carrying out the method discussed above is comprised of a first gate voltage driver 5, a second gate voltage driver 6 and a controller 7.

Figure 4:
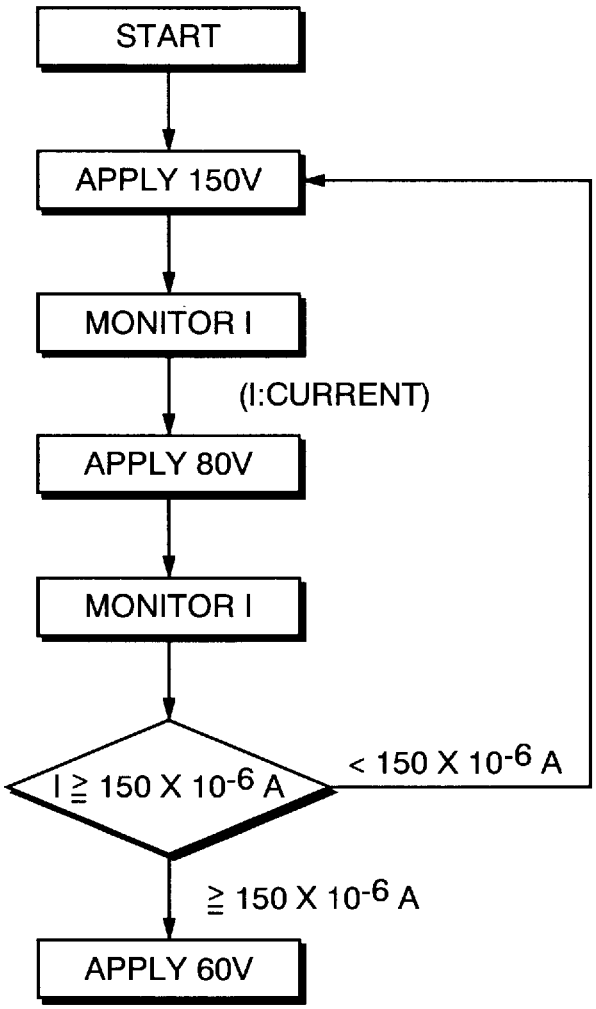
FIG. 4 is a flow chart of a preferred implementation of the present invention.
Figure 5:
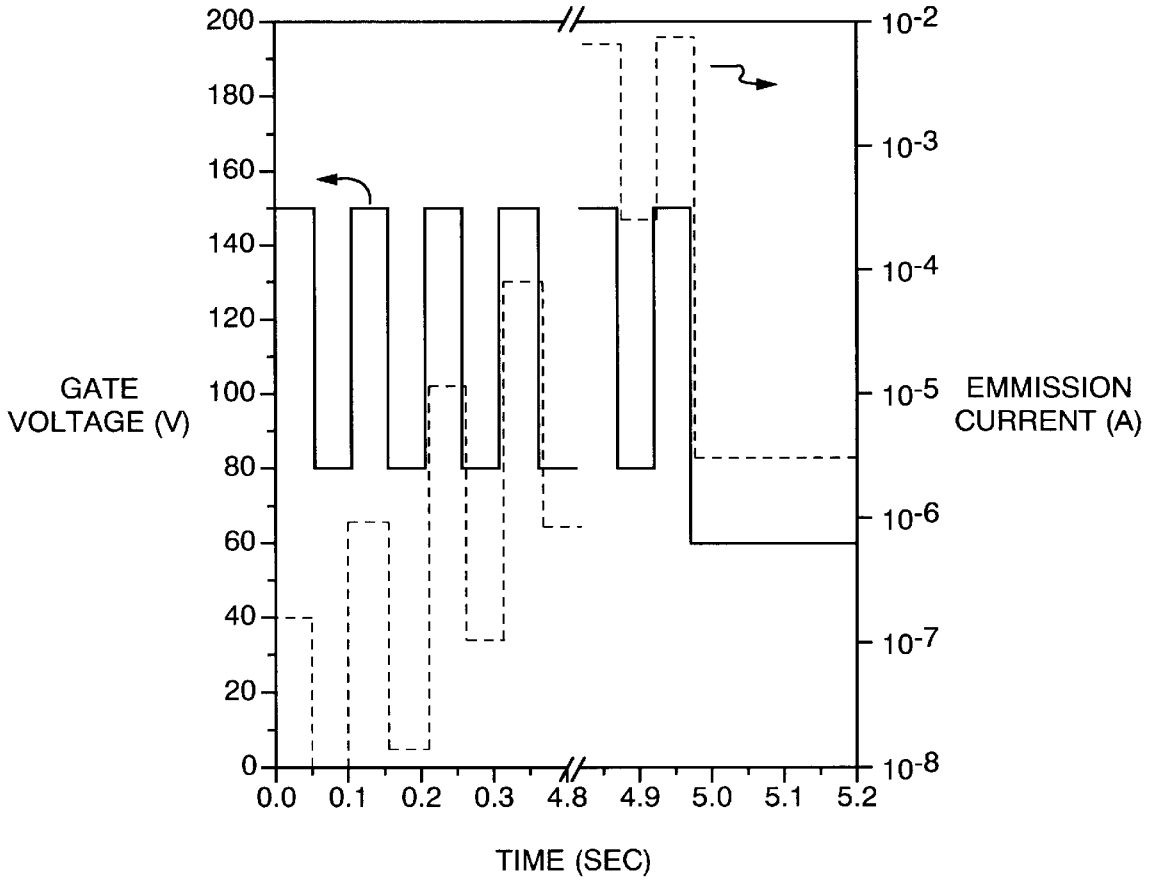
FIG. 5 is a timing diagram of schedule of application of gate voltage according to the present invention and the resultant variations of field emission current.

Until the desired emission current for the maximum one of operating gate voltages is reached, the first gate voltage driver 5 applies an activation voltage, which is higher than any of the operating gate voltages, to the gate layer 1. The second gate voltage driver 6 applies a selected one of the operating gate voltages to the gate layer 1 to provide a desired emission current corresponding to the applied gate voltage. The controller 7 controls switching between the first and second gate voltage drivers 5 and 6. The controller 7 renders the second gate voltage driver 6 inoperable and renders the first gate voltage 5 operable immediately after the desired emission current corresponding to the maximum operating gate voltage has been reached FIG. 4 is a flow chart implementing the present invention. FIG. 5 is a timing diagram of application of activation voltage and variations of field emission current. FIG. 5 illustrates process of activating the emitter tip 4 before operating the field emission cathode on operating gate voltage of 60 V.

The emission current of 150 $\mu$A ($1.5\times10^{-4}$ A) is obtained for applied maximum operating gate voltage of 80 V. The emission current of 3 $\mu$A ($3\times10^{-6}$ A) is obtained for applied operating gate voltage of 60 V.

In FIG. 5, the fully drawn line indicates the activation voltage and the dotted line indicates the emission current. When the field emission cathode is to be operated on applied operating gate voltage of 60 V, the first gate voltage driver 5 is rendered operable beforehand to apply a pulse voltage with two voltage levels of 150 V and 80 V to the gate layer (gate electrode) 1. The pulse has a duty ratio of 50% at a frequency of 10 Hz. The frequency is so chosen as to permit the emission current to change with the pulse voltage.

In synchronous with the pulse voltage, the emission current is monitored. Specifically, the emission current while 150 V is being applied is monitored and then the emission current while 80 V is being applied is monitored as shown in FIG. 4. Application of the pulse voltage continues until the desired level for the applied operating gate voltage 80 V is reached. This desired level is 150 $\mu$A ($150\times10^{-6}$ A) and it is determined whether this level is reached after conducting comparison with the monitored data of the emission current (see FIG. 4). Specifically, the comparison with the monitored data stored while 80 V is being applied is sufficient for determining whether or not the emitter tip has been activated.

Immediately after the desired level of 150 $\mu$A has been reached, the first gate voltage driver 5 is rendered inoperable and the second gate voltage driver 6 is rendered operable to apply 60 V to the gate layer 1. In this case, as shown in FIG. 5, it takes about 5 seconds until the desired level of 3 $\mu$A for the applied gate voltage 60 V is reached.

With the controller 7 that is programmed along the flow chart of FIG. 4, it is now possible to shorten time required for activation of the emitter tip 4. Besides, monitoring the emission current has made it possible automatically detect whether or not the emitter tip 4 has been activated.

From the preceding description regarding the preferred embodiments of the invention, it is appreciated that time required for activation of the emitter tip has reduced remarkably. It is also appreciated that simple addition of the driving apparatus has made it possible to quickly activate the emitter tip, thus providing stable emission current characteristic.

What is claimed is:

1. A method of holding a field emission cathode in a standby state ready for providing emission current when operated with applied one of predetermined operating gate voltages, the field emission cathode having an emitter tip, on a conductive layer, disposed within holes formed through an insulating layer deposited on the conductive layer and a gate layer deposited on the insulating layer, respectively, the method comprising the steps in sequence of;

applying to the gate layer an activation voltage having at least one voltage level that is not less than any one of the voltage levels of the predetermined operating gate voltages to activate the emitter tip until any surface contaminants present on the emitter tip drop to a sufficiently low level; and applying to the gate layer one of the predetermined operating gate voltages to draw electrons out of the emitter tip to provide field emission current as high as a level corresponding to the applied operating gate voltage.

2. A method as claimed in claim 1, wherein the upper limit of said activation voltage is a voltage that corresponds to a breakdown field of the insulating layer.

3. A method as claimed in claim 2, wherein said breakdown field is 3 MV/cm.

4. A method as claimed in claim 1, wherein application of said activation voltage to the gate layer is performed after the field emission cathode has been mounted in a tube and before application of at least one of said predetermined operating gate voltages to the gate layer.

5. A method as claimed in claim 1, wherein application of said activation voltage to the gate layer is performed after 50 hours have passed since at least one of said operating gate voltages have been applied last.

6. A method as claimed in claim 1, wherein the upper limit of said activation voltage is a voltage that corresponds to a breakdown field of the insulating layer.

7. A method as claimed in claim 6, wherein the insulating layer comprises silicone dioxide having a thickness of 500 nm, and the upper limit of said activation voltage is 150 Volts.

8. A method as claimed in claim 1, wherein the upper limit of said activation voltage is a voltage that corresponds to a breakdown field falling in a range of 3 MV/cm to 8 MV/cm, and wherein said application of said activation voltage with the voltage level at the upper limit is interrupted upon elapse of a predetermined period of time.

9. A method as claimed in claim 8, wherein said predetermined period of time is several seconds.

10. An apparatus for holding a field emission cathode in a standby state ready for providing emission current when operated with applied one of predetermined gate voltages, the field emission cathode having an emitter tip, on a conductive layer, disposed within holes formed through an insulating layer deposited on the conductive layer and a gate layer deposited on the insulating layer, respectively, the apparatus comprising:

a first gate voltage driver operable, when rendered operable, to apply to the gate layer an activation voltage level that is not less than any one of the voltage levels of the operating gate voltages to activate the emitter tip until any surface contaminants present on the emitter tip drop to a sufficiently low level;

a second gate voltage driver operable, when rendered operable, to apply at least one of said predetermined operating gate voltages to the field emission cathode, to draw electrons out of the emitter tip to provide field emission current for said applied operating gate voltage; and a controller operable to render said first gate voltage driver inoperable and render said second gate voltage driver operable when said desired emission current has been reached.

11. A method of holding a field emission cathode in a standby state ready for providing emission current when operated with applied one of predetermined operating gate voltages, the field emission cathode having an emitter tip, on a conductive layer, disposed within holes formed through an insulating layer deposited on the conductive layer and a gate layer deposited on the insulating layer, respectively, the method comprising the steps in sequence of:

monitoring field emission current due to electrons out of the emitter tip;

applying to the gate layer a pulse voltage that has two voltage levels, which are not less than any one of voltage levels of the predetermined operating gate voltages, until field emission current as high as a predetermined level is monitored; and applying to the gate layer one of the predetermined operating gate voltages to draw electrons out of the emitter tip to provide field emission current as high as a level corresponding to the applied operating gate voltage.

* * * * *